US009246276B2

(12) United States Patent
Gao

(10) Patent No.: US 9,246,276 B2
(45) Date of Patent: Jan. 26, 2016

(54) ELECTRICAL CONNECTOR HAVING A SHIELDING MEMBER DISPOSED BETWEEN TWO MAGNETIC MODULES

(71) Applicant: HON HAI PRECISION INDUSTRY CO., LTD., New Taipei (TW)

(72) Inventor: Sheng-Pin Gao, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/334,611

(22) Filed: Jul. 17, 2014

(65) Prior Publication Data

US 2015/0024614 A1 Jan. 22, 2015

(30) Foreign Application Priority Data

Jul. 18, 2013 (CN) ..... 2013 1 03010585

(51) Int. Cl.

| | |
|---|---|
| ***H01R 13/658*** | (2011.01) |
| ***H01R 13/6581*** | (2011.01) |
| ***H01R 12/70*** | (2011.01) |
| ***H01R 13/514*** | (2006.01) |
| ***H01R 24/64*** | (2011.01) |

(52) U.S. Cl.

CPC ..... *H01R 13/6581* (2013.01); *H01R 12/70* (2013.01); *H01R 13/514* (2013.01); *H01R 24/64* (2013.01)

(58) Field of Classification Search

CPC ... H01R 13/6581; H01R 24/64; H01R 13/659
See application file for complete search history.

(56) References Cited

U.S. PATENT DOCUMENTS

| | | | | |
|---|---|---|---|---|
| 6,537,110 | B1 * | 3/2003 | Hyland et al. ..... | H01R 13/6658 439/38 |
| 8,636,545 | B2 * | 1/2014 | Chow et al. ..... | H01R 13/514 439/607.27 |
| 2011/0167869 | A1 * | 7/2011 | Geers et al. ..... | H01F 5/04 62/637 |
| 2014/0349519 | A1 * | 11/2014 | Gao et al. ..... | H01R 13/648 439/607.01 |
| 2015/0024614 | A1 * | 1/2015 | Gao ..... | H01R 13/514 439/78 |
| 2015/0056825 | A1 * | 2/2015 | Hsu et al. ..... | H01R 13/6587 439/78 |
| 2015/0056826 | A1 * | 2/2015 | Gao et al. ..... | H01R 13/6633 439/78 |
| 2015/0056827 | A1 * | 2/2015 | Gao et al. ..... | H01R 13/6587 439/78 |

* cited by examiner

*Primary Examiner* — Ross Gushi
(74) *Attorney, Agent, or Firm* — Ming Chieh Chang; Wei Te Chung

(57) ABSTRACT

An electrical connector includes an insulative housing defining a lower inserting port, an upper inserting port stacked thereon, and a mounting port located behind the lower and upper inserting ports. The inserting module is assembled from the mounting port to the inserting ports. The inserting module comprises a set of upper mating contacts each having a contacting portion extending into the upper inserting port, a set of lower mating contacts each having a contacting portion extending into the lower inserting port, a first magnetic module received in the mounting port and electrically connecting with the upper mating contacts, a second magnetic module received in the mounting port and electrically connecting with the lower mating contacts, and a conductive shielding member disposed between the first and second magnetic modules for shielding electromagnetic interference (EMI) therebetween. The conductive shielding member is a flexible member and connecting with the PCBs through pressing.

16 Claims, 6 Drawing Sheets

ELECTRICAL CONNECTOR HAVING A SHIELDING MEMBER DISPOSED BETWEEN TWO MAGNETIC MODULES

BACKGROUND OF THE INVENTION

1. Field of the Invention

The present invention relates to an electrical connector, especially to a shielding member of the electrical connector disposed between two magnetic modules.

2. Description of Related Art

U.S. Patent Application Publication No. 2011/0167869, published on Jul. 14, 2011 discloses a modular jack used for 10 Gbps Ethernet. The modular jack comprises an insulative housing defining a lower inserting port, an upper inserting port stacked thereon, and a mounting port located behind the lower and upper inserting ports. An inserting module is assembled from the mounting port to the inserting ports. The inserting module comprises a set of upper mating contacts each having a contacting portion extending into the upper inserting port, a set of lower mating contacts each having a contacting portion extending into the lower inserting port, a first magnetic module received in the mounting port and electrically connecting with the upper mating contacts, a second magnetic module received in the mounting port and electrically connecting with the lower mating contacts, and a conductive shielding member disposed between the first and second magnetic modules for shielding electromagnetic interference (EMI) therebetween. The conductive shielding member is made of a metal plate and is sandwiched between two foam inserts. The conductive shielding member has three top taps for inserting and soldering to a top printed circuit board (PCB) and six bottom taps for inserting and soldering to a lower PCB. The metal plate is stamped from metal material which is expensive and the cost of the stamping dies is also high. Moreover, mounting the taps to corresponding holes of the PCBs and soldering the taps to PCBs are also complex and time-consuming.

An electrical connector with low manufacturing cost is desired.

SUMMARY OF THE INVENTION

Accordingly, an object of the present invention is to provide an electrical connector with a simple structure and low manufacturing cost.

In order to achieve the object set forth, the invention provides an electrical connector comprises an insulative housing defining a lower inserting port, an upper inserting port stacked thereon, and a mounting port located behind the lower and upper inserting ports. The inserting module is assembled from the mounting port to the inserting ports. The inserting module comprises a set of upper mating contacts each having a contacting portion extending upwardly and backwardly into the upper inserting port, a set of lower mating contacts each having a contacting portion extending downwardly and backwardly into the lower inserting port, a first magnetic module received in the mounting port and electrically connecting with the upper mating contacts, a second magnetic module received in the mounting port and electrically connecting with the lower mating contacts, and a conductive shielding member disposed between the first and second magnetic modules for shielding electromagnetic interference (EMI) therebetween. The conductive shielding member is a flexible member and connecting with the PCBs through pressing. The flexible shielding member does not need taps for being assembled into holes of the PCBs and soldered thereto. The manufacturing and assembling cost of the flexible shielding member is lower than a metal plate's.

Other objects, advantages and novel features of the invention will become more apparent from the following detailed description when taken in conjunction with the accompanying drawings.

DETAILED DESCRIPTION OF THE PREFERRED EMBODIMENT

Figure 1:
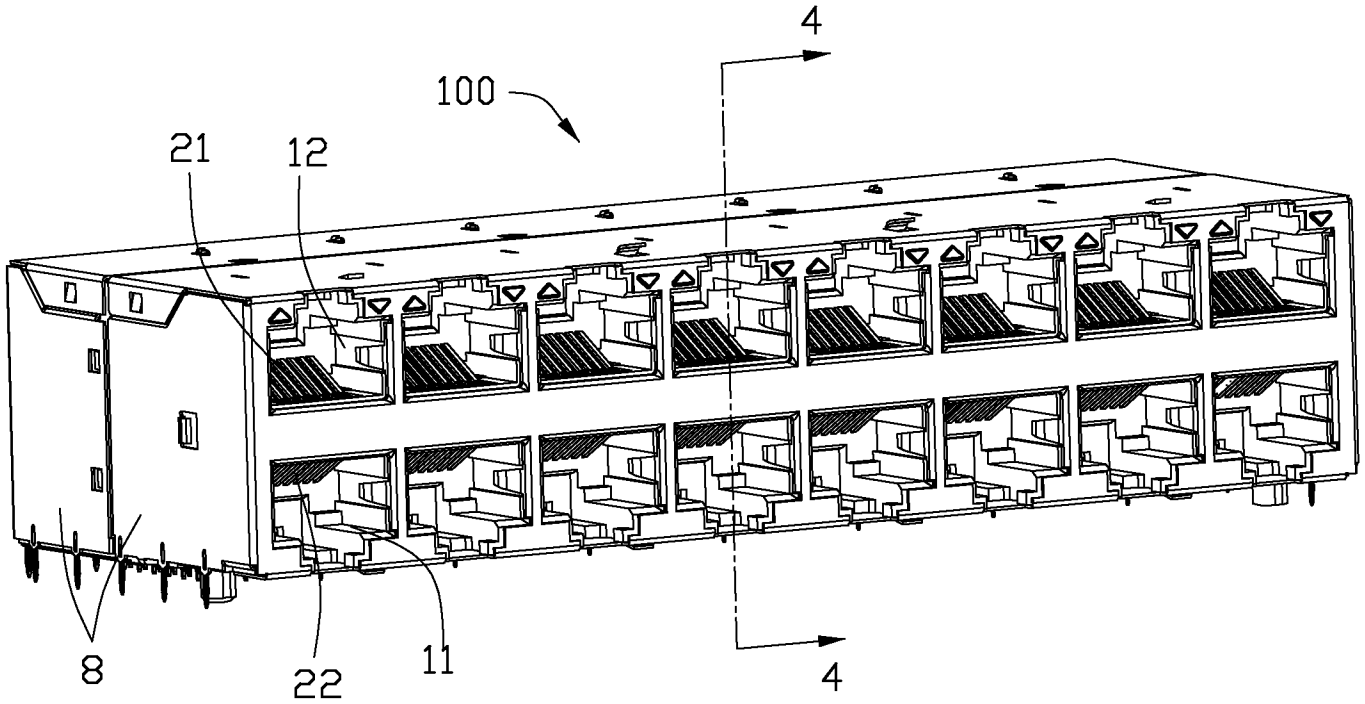
FIG. 1 is a perspective view of an electrical connector according to the invention.
Figure 2:
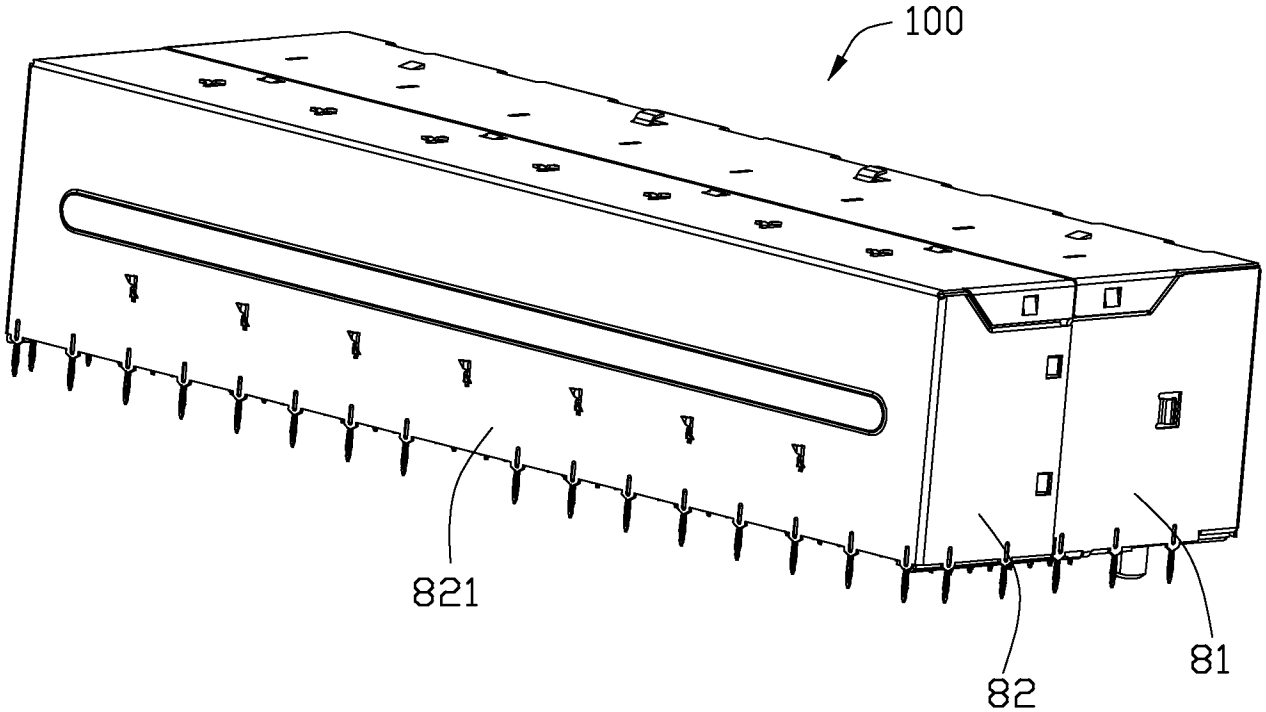
FIG. 2 is another perspective view of the electrical connector shown in FIG. 1.

Reference will now be made in detail to the preferred embodiment of the present invention.

Referring to FIGS. 1-6, an electrical connector 100 according to the present invention is shown.

The electrical connector 100 is a 2XN modular jack (RJ45) for transmission of 10 Gbit/s network signal. The electrical connector 100 includes an insulative housing 1, a row of inserting modules 2 mounted to the insulative housing 1 along a back-to-front direction, a row of light pipes 7 installed to the insulative housing 1 along the back-to-direction, a shielding shell 8 surrounding the insulative housing 1 and the inserting module 2, and a row of shielding plates 9 each disposed between two adjacent inserting module 2.

The insulative housing 1 includes a row of lower inserting ports 11, a row of upper inserting ports 12 stacked thereon, and a mounting port 13 located behind the lower and upper inserting ports 11, 12. Each upper inserting port 12 is stacked corresponding lower inserting port 11. Each inserting module 2 is assembled to the insulative housing 1 from the mounting port 13 to corresponding lower and upper inserting ports 11, 12.

The insulative housing includes a front wall 15, a top wall 16, a bottom wall 17, a rear wall 18, and a pair of side walls 19 extending backwardly over the top wall 16 and the bottom wall 17. The inserting ports 11, 12 are recessed from the front wall 15 backwardly and used for insertion of modular plugs (not shown). The mounting port 13 is defined by the rear wall 18 and the side walls 19. The inserting ports 11, 12 are interconnected with the mounting port 13 along a front-to-back direction.

The inserting module 2 includes a top printed circuit board (PCB) 21, a set of upper mating contacts 22 connecting with a top face 211 of the top PCB 21, a set of lower contacts 23 connecting with a lower face 212 of the top PCB 21, a lower PCB 24, a first magnetic module 25 and a second magnetic module 26 disposed between the top PCB 21 and the lower PCB 23, and a conductive shielding member 27 disposed between the first and second magnetic modules 25, 26 for shielding electromagnetic interference (EMI) therebetween. Each upper mating contact 22 includes a contacting portion 221 extending upwardly and backwardly into the upper inserting port 12, a soldering portion 222 surface mounted on the top face 211, and a buried portion (not shown) insert molding with an insulative block 224 which mounting on the top face 211. Each lower mating contact 23 includes a contacting portion 231 extending downwardly and backwardly into the lower inserting port 11, a soldering portion 232 surface mounted on the lower face 212, and a buried portion insert molding with the an insulative block 234 which mounting on the lower face 212.

The first magnetic module 25 is received in the mounting port 13 and electrically connecting with the upper mating contacts 22 through the top PCB 21. The second magnetic module 26 is received in the mounting port 13 and electrically connecting with the lower mating contacts 23 through the top PCB 21.

The inserting module 2 includes a plurality of grounding contacts 28 mounted on the lower PCB 24. Each grounding contact 28 includes a top portion 281 disposed above the bottom PCB 23, a middle portion 282 inserted in a through hole 230 of the bottom PCB 23, and a bottom portion 283 below the bottom PCB 23 for mounting to an exterior substrate (not shown). The conductive shielding member 27 connects with the top portions 281 of the grounding contacts 28 through pressing. The top PCB 21 has a grounding point 213 disposed at the lower face 212 for connecting with the conductive shielding member 27 through pressing.

The first magnetic module 25 includes an insulative carrier 251, a plurality of upper connecting contacts 252 hold by a top section of the insulative carrier 251, a plurality of lower connecting contacts 253 hold by a bottom section of the insulative carrier 251, and a plurality of magnetic coils (not shown) having two sets of opposite ends for connecting with upper and lower connecting contacts 252, 253 respectively. The insulative carrier 251 has a receiving slot 250 for receiving the magnetic coils functioned as transformers and common mode chokes. The second magnetic module 26 includes an insulative carrier 261, a plurality of upper connecting contacts 262 hold by a top section of the insulative carrier 261, a plurality of lower connecting contacts 263 hold by a bottom section of the insulative carrier 261, and a plurality of magnetic coils (not shown) having two sets of opposite ends for connecting with upper and lower connecting contacts 262, 263 respectively. The insulative carrier 261 has a receiving slot 260 for receiving the magnetic coils functioned as transformers and common mode chokes. The receiving slot 250 of the first magnetic module 25 opens along a first direction. The receiving slot 260 of the second magnetic module 26 opens along a second direction opposite to the first direction. The carrier 251 of the first magnetic module 25 has a post 255 extending toward to the second magnetic module 26 and the second magnetic module 26 has a mounting hole 265 for the post 255 inserting therein. The conductive shielding member 27 defines a through hole 270 for the post 255 passing over. The upper connecting contacts 252, 262 are inserted into the conductive hole 210 of the top PCB 21 and soldered to the top PCB 21. The lower connecting contacts 253, 263 are used connected to the exterior substrate.

The conductive shielding member 27 is a flexible member such as conductive foam which is cheap. The conductive shielding member 27 includes a body portion 271, a rear connecting portion 272 located behind the body portion 271, a top connecting portion 273 located upon the body portion 271. The rear connecting portion 273 connects with the shielding shell 8 through pressing and the top connecting portion connects with the top PCB 21 through pressing.

The shielding shell 8 has a front shell 81 and a rear shell 82 assembled together. The a rear shell 82 has a rear wall 821. The rear connecting portion 272 is disposed perpendicular to body portion 271 and parallel to the rear wall 821. The top connecting portion 273 is disposed perpendicular to the body portion 271 and parallel to the top PCB 21.

Figure 4:
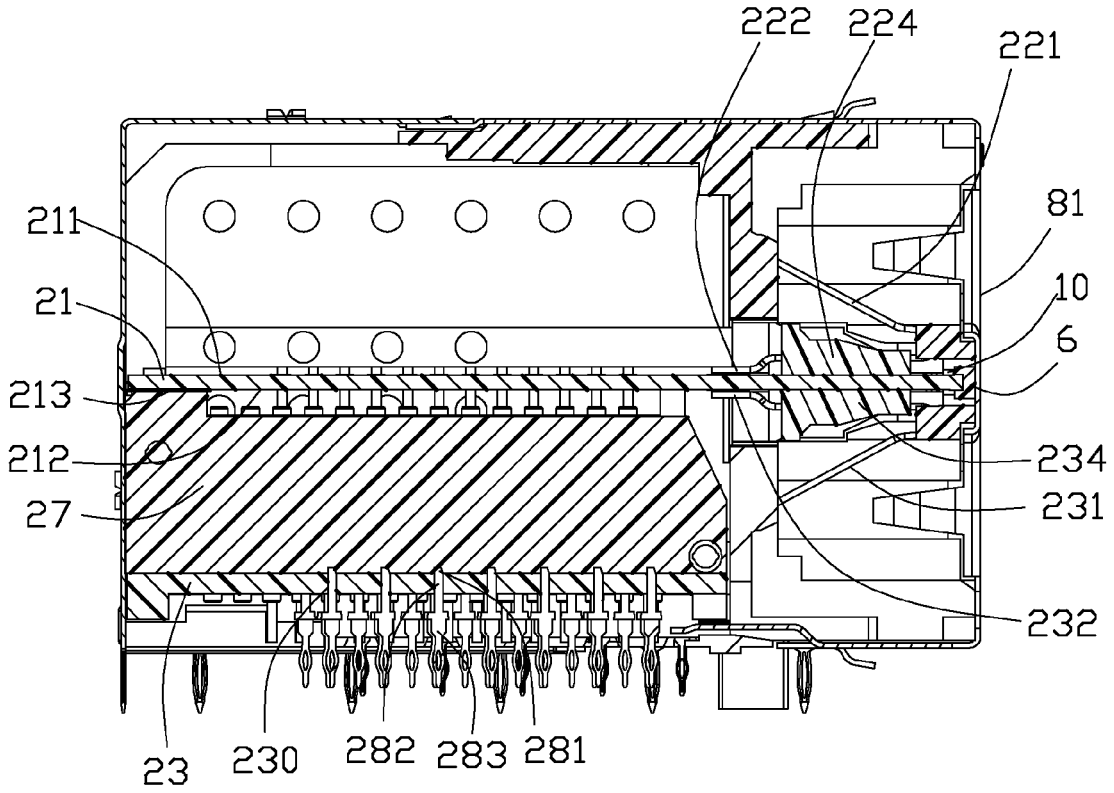
FIG. 4 is a cross-sectional view of the electrical connector seen in FIG. 1, taken along line 4-4.
Figure 5:
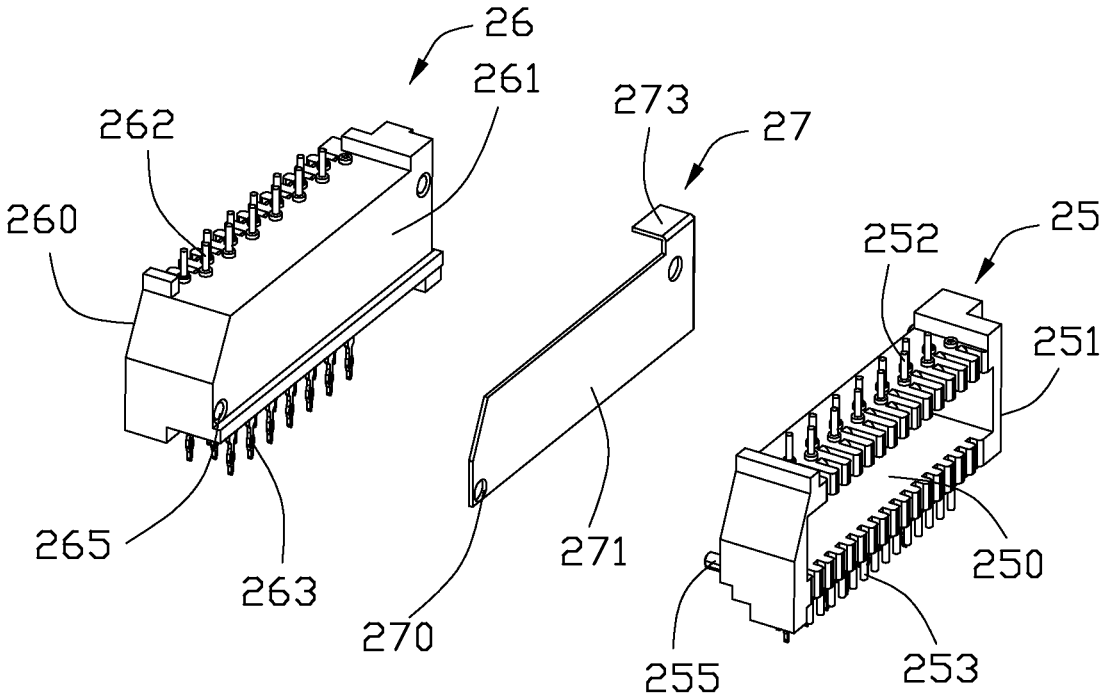
FIG. 5 is an exploded view of magnetic modules and conductive shielding member shown in FIG. 3.
Figure 6:
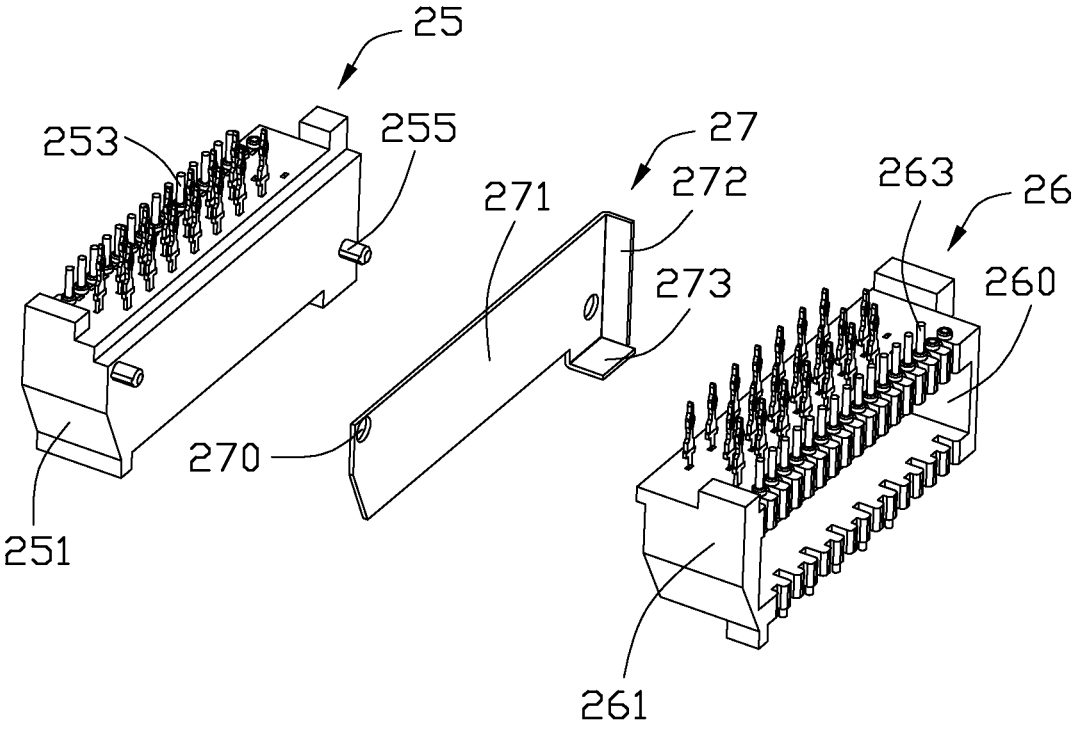
FIG. 6 is another exploded view of magnetic modules and conductive shielding member shown in FIG. 3.

Referring to FIG. 4, the insulative housing 1 has a mounting hole 10 disposed between the lower and upper inserting ports 11, 12 and extending along a front-to-back direction. The electrical connector 100 has a front conductive foam 6 received in the mounting hole 10 and connecting with the front shell 81. The top PCB 21 is inserted into the mounting hole 10 forwardly to connect the front conductive foam 6 that a grounding layer (not shown) of the top PCB 21 electrically connecting with the front shell 81 through the front conductive foam 6.

Figure 3:
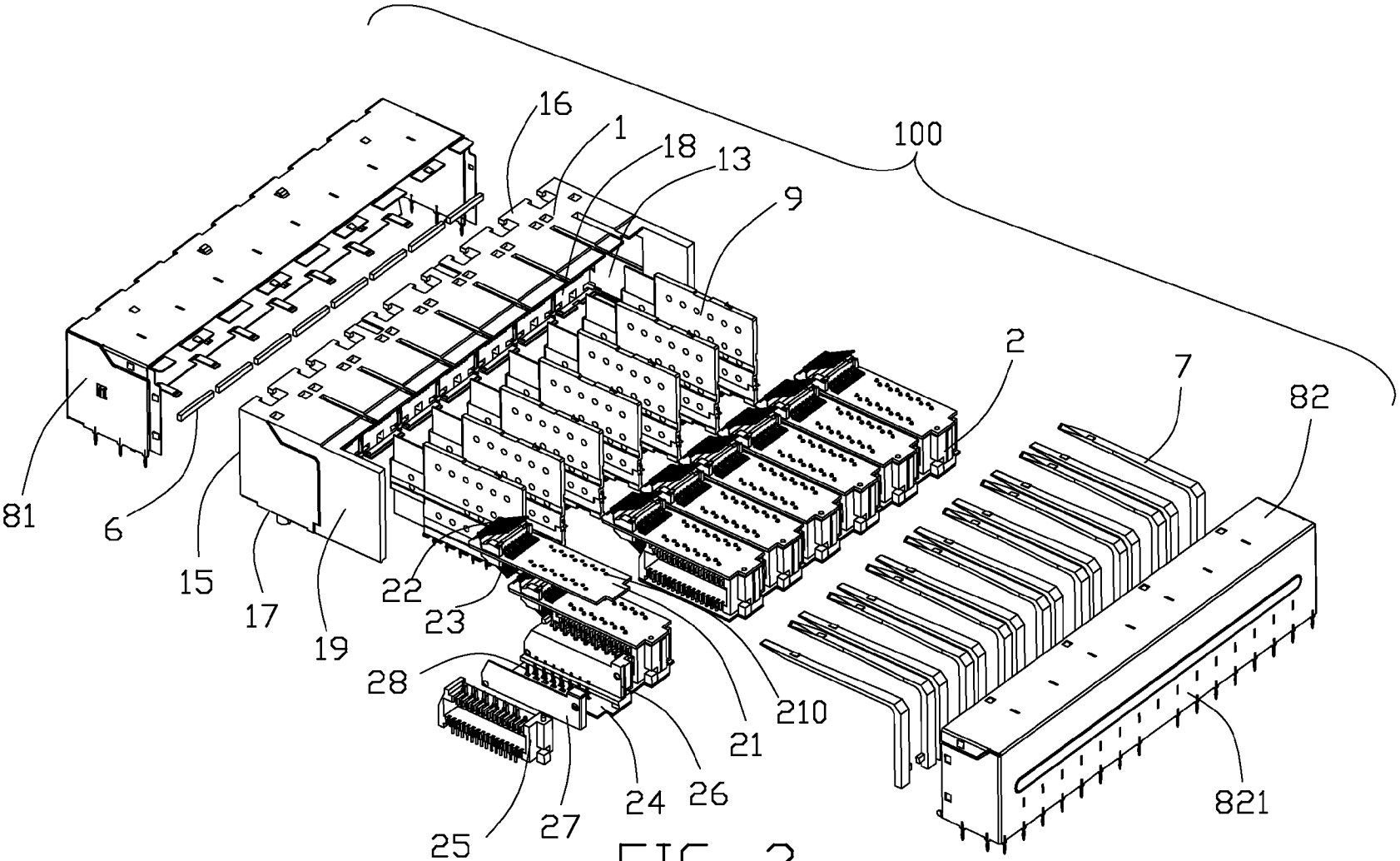
FIG. 3 is an exploded view of the electrical connector shown in FIG. 2.

Referring to FIG. 3, the shielding plate 9 is made of a metal plate insert molding with an insulative material. The shielding plate 9 is used for shielding EMI between two adjacent inserting modules 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

an insulative housing defining a lower inserting port, an upper inserting port stacked thereon, and a mounting port located behind the lower and upper inserting ports; and an inserting module assembled from the mounting port to the inserting ports, the inserting module comprising:

a set of upper mating contacts each having a contacting portion extending upwardly and backwardly into the upper inserting port;

a set of lower mating contacts each having a contacting portion extending downwardly and backwardly into the lower inserting port;

a first magnetic module received in the mounting port and electrically connecting with the upper mating contacts;

a second magnetic module received in the mounting port and electrically connecting with the lower mating contacts; and a conductive shielding member disposed between the first and second magnetic modules for shielding electromagnetic interference (EMI) therebetween; wherein the conductive shielding member is a flexible member and is formed with conductive foam.

2. The electrical connector as claimed in claim 1, wherein said inserting module includes a bottom printed circuit board (PCB) below the magnetic modules and a plurality of grounding contacts extending along a top-to-bottom direction, each grounding contact including a top portion disposed above the bottom PCB, a middle portion inserted in a through hole of the bottom PCB, and a bottom portion below the bottom PCB for mounting to an exterior substrate, the conductive shielding member connecting with the top portions of the grounding contacts.

3. The electrical connector as claimed in claim 1, wherein each of the first and second magnetic modules includes an insulative carrier, a plurality of upper connecting contacts held by a top section of the insulative carrier, a plurality of lower connecting contacts held by a bottom section of the insulative carrier, and a plurality of magnetic coils having two sets of opposite ends for connecting with upper and lower connecting contacts respectively.

4. The electrical connector as claimed in claim 3, wherein each insulative carrier has a receiving slot for receiving the magnetic coils functioned as transformers and common mode chokes, the receiving slot of the first magnetic module opening along a first direction and the receiving slot of the second magnetic module opening along a second direction opposite to the first direction.

5. The electrical connector as claimed in claim 3, wherein the insulative carrier of the first magnetic module has a post extending toward the second magnetic module and the second magnetic module has a mounting hole for receiving the post, the conductive shielding member defining a through hole for the post to pass over.

6. An electrical connector comprising:

an insulative housing defining a lower inserting port and an upper inserting port stacked thereon, and a mounting port located behind the lower and upper inserting ports in a front-to-back direction; and an inserting module assembled from the mounting port to the inserting ports, the inserting module comprising:

a top PCB (printed circuit board) extending in a horizontal plane defined by said front-to-back direction and a transverse direction perpendicular to said front-to-back direction, and located between the upper inserting port and the lower inserting port viewed in a vertical direction perpendicular to both said front-to-back direction and said transverse direction;

a set of upper mating contacts each having a contacting portion extending into the upper inserting port and a mounting portion mounted to the top PCB;

a set of lower mating contacts each having a contacting portion extending into the lower inserting port and a mounting portion mounted to the top PCB;

a magnetic module received in the mounting port and electrically connecting with at least either the upper mating contacts or the lower mating contacts;

a conductive shielding member disposed beside magnetic modules for shielding electromagnetic interference (EMI) in said transverse direction; wherein the conductive shielding member is wholly compressible in the vertical direction and mechanically and electrically connected to the top PCB in a compressed manner.

7. The electrical connector as claimed in claim 6, wherein said shielding member is wholly compressible in the transverse direction.

8. The electrical connector as claimed in claim 6, further including a lower PCB parallel to said top PCB with the magnetic module sandwiched therebetween in the vertical direction, wherein said shielding member is mechanically and electrically connected to the lower PCB in a compressed manner.

9. The electrical connector as claimed in claim 6, wherein said shielding member extends in a vertical plane perpendicular to said horizontal plane and defined by said vertical direction and said front-to-back direction.

10. The electrical connector as claimed in claim 6, wherein said shielding member connects to a center region of the top PCB in said transverse direction.

11. The electrical connector as claimed in claim 6, further including means for aligning and assembling the shielding member to the magnetic module in the transverse direction.

12. The electrical connector as claimed in claim 6, further including another magnetic module to cooperate with said magnetic module to commonly sandwich the shielding member therebetween in the transverse direction.

13. The electrical connector as claimed in claim 6, wherein said shielding member is a conductive foam.

14. An electrical connector comprising:

an insulative housing defining a lower inserting port, an upper inserting port stacked thereon, and a mounting port located behind the lower and upper inserting ports;

an inserting module assembled from the mounting port to the inserting ports, the inserting module comprising:

a set of upper mating contacts each having a contacting portion extending upwardly and backwardly into the upper inserting port;

a set of lower mating contacts each having a contacting portion extending downwardly and backwardly into the lower inserting port;

a first magnetic module received in the mounting port and electrically connecting with the upper mating contacts;

a second magnetic module received in the mounting port and electrically connecting with the lower mating contacts; and a conductive shielding member disposed between the first and second magnetic modules for shielding electromagnetic interference (EMI) therebetween; and a shielding shell surrounding the insulative housing and the inserting module;

wherein the conductive shielding member is a flexible member, wherein the inserting module comprises a top printed circuit board (PCB) disposed above the magnetic modules, the top PCB having a grounding point for connecting with the conductive shielding member, and wherein the conductive shielding member includes a body portion, a rear connecting portion located behind the body portion, and a top connecting portion located upon the body portion, the rear connecting portion connecting with the shielding shell, the top connecting portion connecting with the top PCB.

15. The electrical connector as claimed in claim 14, wherein the shielding shell has a rear wall, and the rear connecting portion of the conductive shielding member is disposed perpendicular to the body portion and parallel to the rear wall.

16. The electrical connector as claimed in claim 14, wherein the top connecting portion is disposed perpendicular to the body portion and parallel to the top PCB.

* * * * *